US007453207B2

(12) United States Patent
Bae

(10) Patent No.: US 7,453,207 B2
(45) Date of Patent: Nov. 18, 2008

(54) PLASMA DISPLAY DEVICE

(75) Inventor: Sung-Won Bae, Cheonan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 599 days.

(21) Appl. No.: 10/992,075

(22) Filed: Nov. 19, 2004

(65) Prior Publication Data

US 2005/0122019 A1 Jun. 9, 2005

(30) Foreign Application Priority Data

Nov. 25, 2003 (KR) ..... 10-2003-0084189

(51) Int. Cl.
*H01J 17/49* (2006.01)

(52) U.S. Cl. ..... 313/582; 313/634; 313/44; 313/45

(58) Field of Classification Search ..... 313/582, 313/634, 35–36, 44–45
See application file for complete search history.

(56) References Cited

U.S. PATENT DOCUMENTS 5,990,618 A * 11/1999 Morita et al. ..... 313/582
6,288,489 B1 * 9/2001 Isohata et al. ..... 313/582
2002/0043916 A1 * 4/2002 Juen ..... 313/44

FOREIGN PATENT DOCUMENTS

JP 10319863 A * 12/1998
JP 11-065485 3/1999
JP 11065485 A * 3/1999
JP 2000047598 A * 2/2000

OTHER PUBLICATIONS

Chinese Office Action dated Aug. 29, 2008.

* cited by examiner

*Primary Examiner*—Joseph L. Williams
*Assistant Examiner*—Kevin Quarterman
(74) *Attorney, Agent, or Firm*—H.C. Park & Associates, PLC

(57) ABSTRACT

A plasma display device that effectively emits heat generated at a PDP, efficiently blocks heat transfer from a circuit board to the PDP, and securely fastens the PDP. The plasma display device includes a PDP on which images are displayed, a frame member having an opening and contacting a surface of the PDP, and a heat radiation member disposed in the opening.

19 Claims, 8 Drawing Sheets

PLASMA DISPLAY DEVICE

CROSS REFERENCE TO RELATED APPLICATION

This application claims priority to and the benefit of Korean Patent Application No. 10-2003-0084189, filed on Nov. 25, 2003, which is hereby incorporated by reference for all purposes as if fully set forth herein.

BACKGROUND OF THE INVENTION

1. Field of the Invention

The present invention relates to a plasma display device, and more particularly, to a plasma display device having an improved structure to dissipate heat of a plasma display panel (PDP).

2. Discussion of the Related Art

A plasma display device is a flat panel display device that displays images by using a gas discharging effect. Due to its strong performance and characteristics, such as a high display capacity, high brightness, high contrast, clear images, and large viewing angle, the PDP may replace the cathode ray tube (CRT), particularly for large screen displays.

A plasma display device is generally packaged in a cabinet that includes the PDP and a chassis base, and a circuit portion to drive the PDP may be included on a rear surface of the chassis base.

A PDP comprises two substrates that are sealed together to form a discharge space. A plurality of electrode pairs are formed on a first substrate, and a plurality of address electrodes and a plurality of barrier ribs are formed on a second substrate.

A plasma display device with the above structure displays color images by selectively discharging discharge cells. In order to display images, a driving device is coupled to the plurality of address electrodes, and it applies sequentially controlled signals to them.

However, numerous discharges in the PDP generate heat, and failure to effectively remove that heat may adversely effect the PDP's driving characteristics.

Therefore, conventionally, the chassis base may be formed of a high thermal conductivity material, such as aluminum, to dissipate heat generated by the PDP. However, an aluminum chassis base may not contact the PDP because aluminum and glass, which is typically used to form the PDP, have different thermal expansion coefficients, and the PDP glass may break under high heat conditions.

Accordingly, a heat radiation sheet may be interposed between the PDP and the chassis base to transfer heat from the PDP to the outside, via the chassis base.

However, this structure may not optimally transfer heat because the heat is transmitted through the heat radiation sheet and the chassis base.

Also, heat generated from electronic parts on a circuit board, which is mounted on the chassis base, may transfer back to the PDP.

SUMMARY OF THE INVENTION

The present invention provides a plasma display device having an improved structure that may effectively dissipate heat generated at a PDP.

The present invention further provides a plasma display device that may effectively block the transfer of heat from the circuit board to the PDP.

The present invention further provides a plasma display device that securely fastens the PDP.

Additional features of the invention will be set forth in the description which follows, and in part will be apparent from the description, or may be learned by practice of the invention.

The present invention discloses a plasma display device comprising a PDP on which images are displayed, a frame member having an opening and contacting a surface of the PDP, and a heat radiation member disposed in the opening.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
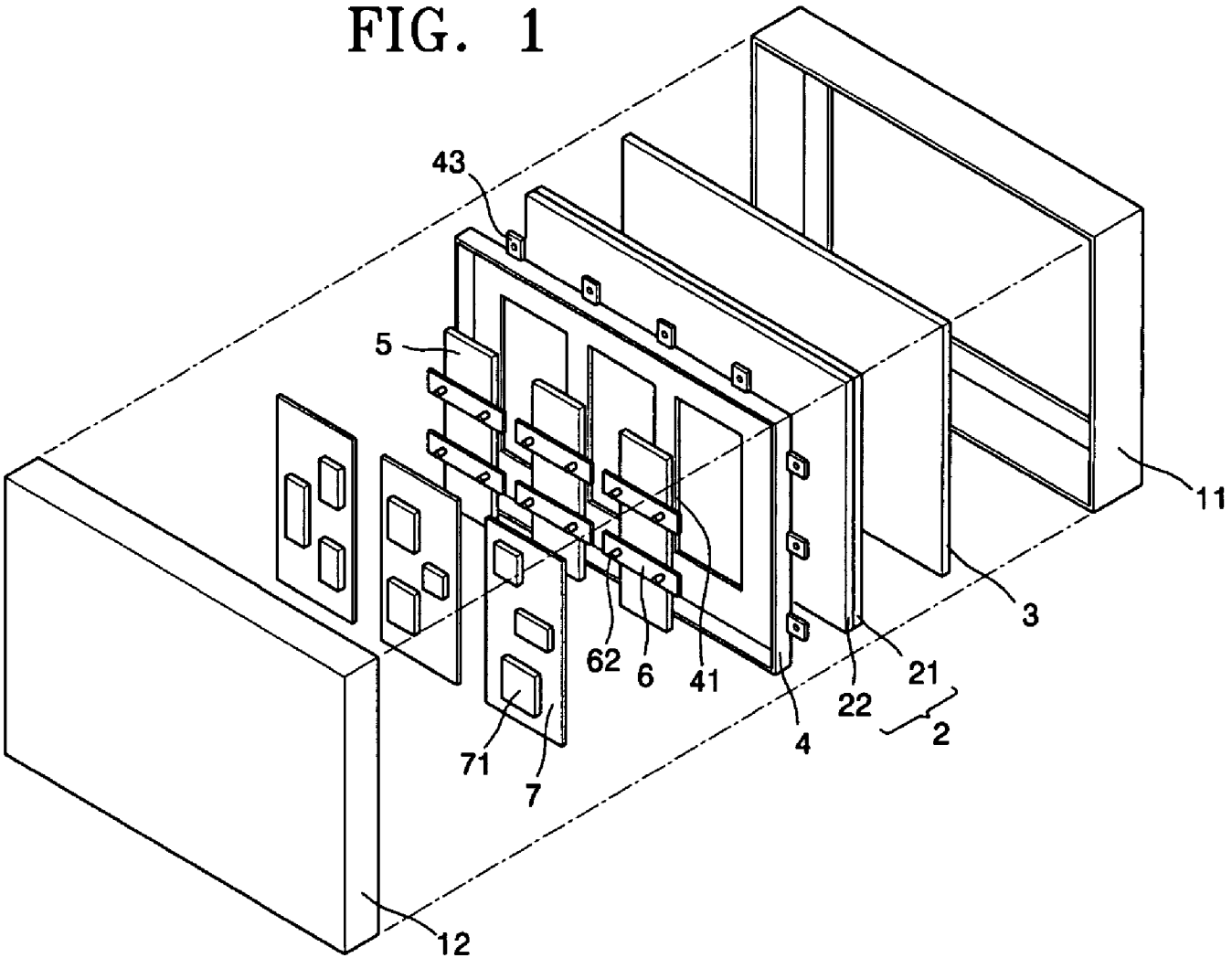
FIG. 1 is an exploded perspective view of a plasma display device according to an exemplary embodiment of the present invention.

The present invention will now be described more fully with reference to the accompanying drawings that show exemplary embodiments of the present invention. The same reference numbers in the drawings refer to the same or similar elements.

Figure 2:
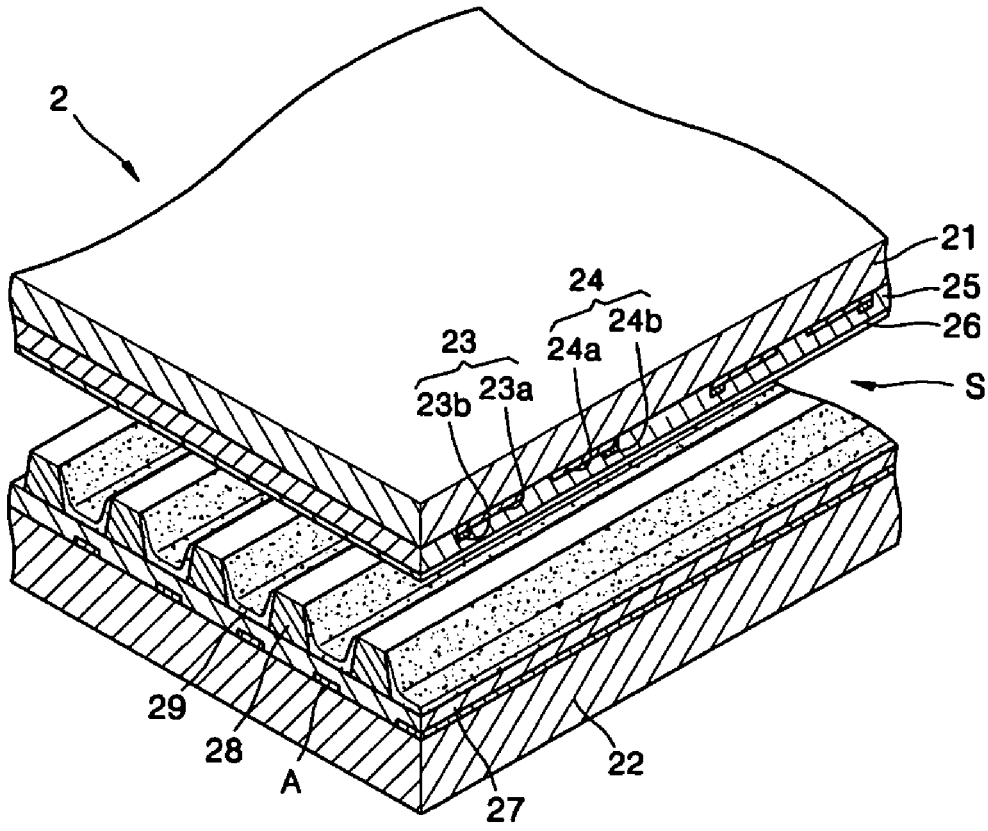
FIG. 2 is a partial perspective view showing a PDP for the plasma display device of FIG. 1.
Figure 3:
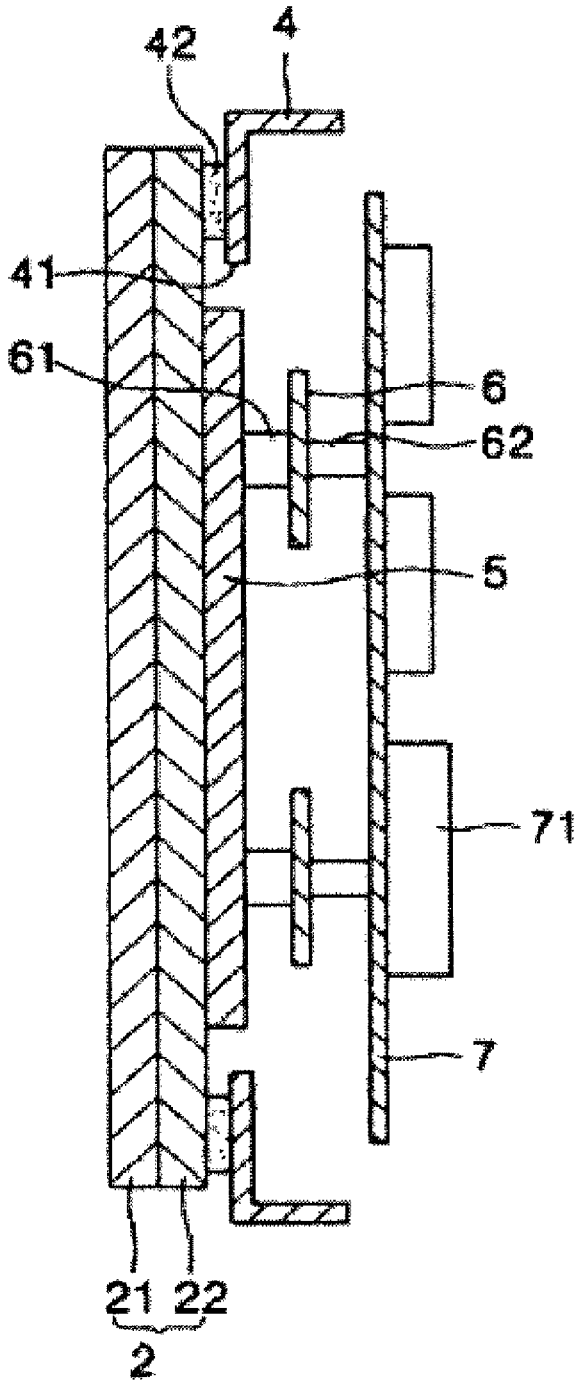
FIG. 3 is a cross-sectional view showing a portion of the plasma display device of FIG. 1.

FIG. 1 is an exploded perspective view showing a plasma display device according to an exemplary embodiment of the present invention. FIG. 2 is a partial perspective view showing a PDP of the plasma display device of FIG. 1, and FIG. 3 is a cross-sectional view showing a portion of the plasma display device of FIG. 1.

Referring to FIG. 1, a plasma display device according to an exemplary embodiment of the present invention comprises a PDP 2, a frame member 4 for securely fastening the PDP 2, and a heat radiation member 5 for dissipating heat generated by the PDP 2. The PDP 2, the frame member 4, and the heat radiation member 5 are housed in a rear case 12, and a front case 11 is joined together with the rear case 12. A filter member 3, which shields infrared rays and electromagnetic waves, may be interposed between PDP 2 and the front case 11.

As shown in FIG. 2, the PDP 2 comprises a front substrate 21 and a rear substrate 22 that are sealed together to form a discharge space S, which may be filled with a discharge gas such as Ne or Xe. Edges of the front substrate 21 and the rear substrate 22 are sealed air-tight by a sealing member such as glass frit.

Address electrodes A are formed on the rear substrate 22 in a predetermined pattern and covered by a dielectric layer 27. A plurality of barrier ribs 28 is formed on the dielectric layer 27 to maintain a discharge distance and prevent electrical and optical cross-talk between pixels. A fluorescent layer 29 may be formed on the dielectric layer 27 and on a side of the barrier ribs 28.

X electrodes 23 and Y electrodes 24 are formed on a lower surface of the front substrate 21. They are formed in parallel pairs, and they are orthogonal to the address electrodes A. The X electrodes 23 and Y electrodes 24 may be used for sustaining discharging, and a crossing point between an X and Y electrode 23 and 24 pair and an address electrode A forms a discharge cell. The X electrodes 23 and the Y electrodes 24 may comprise transparent portions 23*a* and 24*a* and metallic portions 23*b* and 24*b*, respectively.

A dielectric layer 25 covers the X electrodes 23 and Y electrodes 24, and a protection layer 26, which may be made of magnesium oxide (MgO), covers the dielectric layer 25.

A black stripe, made of a black insulating material, may be formed between the pairs of the X electrodes 23 and Y electrodes 24 to improve the contrast of the PDP 2.

The PDP 2 of FIG. 1 is not limited to the exemplary structure described above and shown in FIG. 2.

As shown in FIG. 1 and FIG. 3, the heat radiation member 5 and the frame member 4 are located behind the rear substrate 22 of the PDP 2.

The heat radiation member 5 may contact the rear substrate 22, and the frame member 4 is disposed along the outer edges of the heat radiation member 5.

According to an exemplary embodiment of the present invention, the frame member 4 may have an opening 41 corresponding to each heat radiation member 5. An area of the opening 41 is preferably greater than an area of the heat radiation member 5 because the heat radiation member 5 contacts the PDP 2 through the opening 41. On the other hand, the area of the opening 41 may be less than the area of the heat radiation member 5. In this case, the heat radiation member 5 may overlap the frame member 4 at the edges of the opening 41. Further, FIG. 1 shows that one heat radiation member 5 is disposed in one opening 41. However, more than one heat radiation member 5 may be disposed in one opening 41.

The frame member 4 may be formed of a composite material or a conductive plastic material, but it should not be formed of a metal, such as aluminum. The heat transfer coefficient of the frame member 4 may be greater than 1.0 W/mk.

As shown in FIG. 1 and FIG. 3, the frame member 4 may be adhered to an edge of the PDP 2 by an adhesive member 42, which may be dual-sided tape. The frame member 4 may be coupled to the front case 11 through the coupling unit 43, which is on the frame member's outer edge.

As shown in FIG. 3, the heat radiation member 5 may be a sheet made of a material having high thermal conductivity, and it may contact the rear substrate 22. Therefore, the heat generated at the PDP 2 may be directly transmitted to the heat radiation member 5.

The heat radiation member 5 may be secured to the PDP 2 by a variety of methods. As shown in FIG. 1, according to an exemplary embodiment of the present invention, an auxiliary frame 6 secures the heat radiation member 5 to the PDP 2.

The auxiliary frame 6 may be formed of a metal material, and it may also be formed of a plastic material or a composite material, like the frame member 4.

The auxiliary frame 6 may be wider than the opening 41 and the heat radiation member 5. Also, each end of the auxiliary frame 6 may be coupled to the frame member 4 by a bolt, a rivet, welding, or other like means. Attaching the auxiliary frame 6 to the frame member 4 prevents the heat radiation member 5 from losing contact with the PDP 2.

Figure 5:
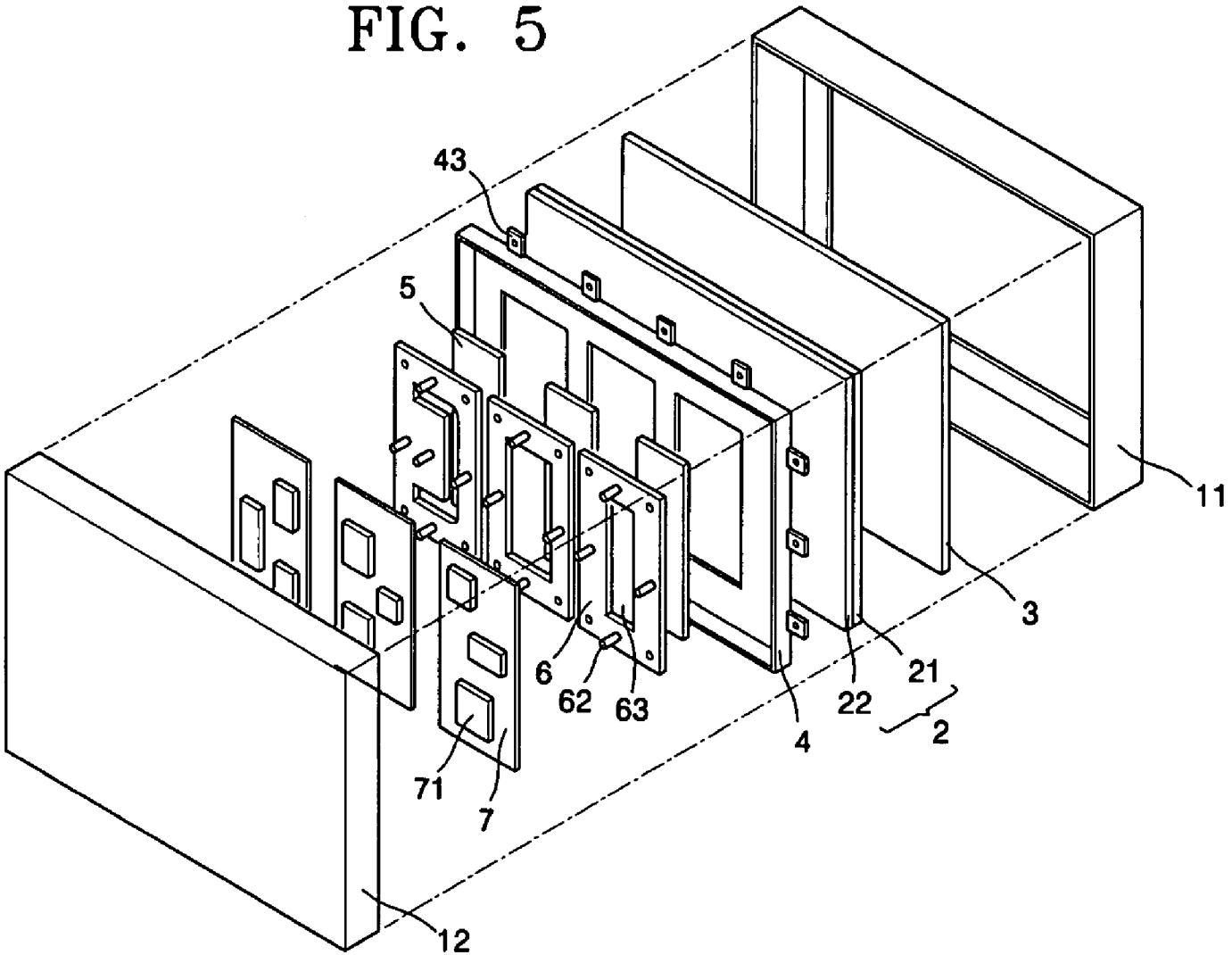
FIG. 5 is an exploded perspective view of a plasma display device having a plate shaped auxiliary frame according to another exemplary embodiment of the present invention.
Figure 6:
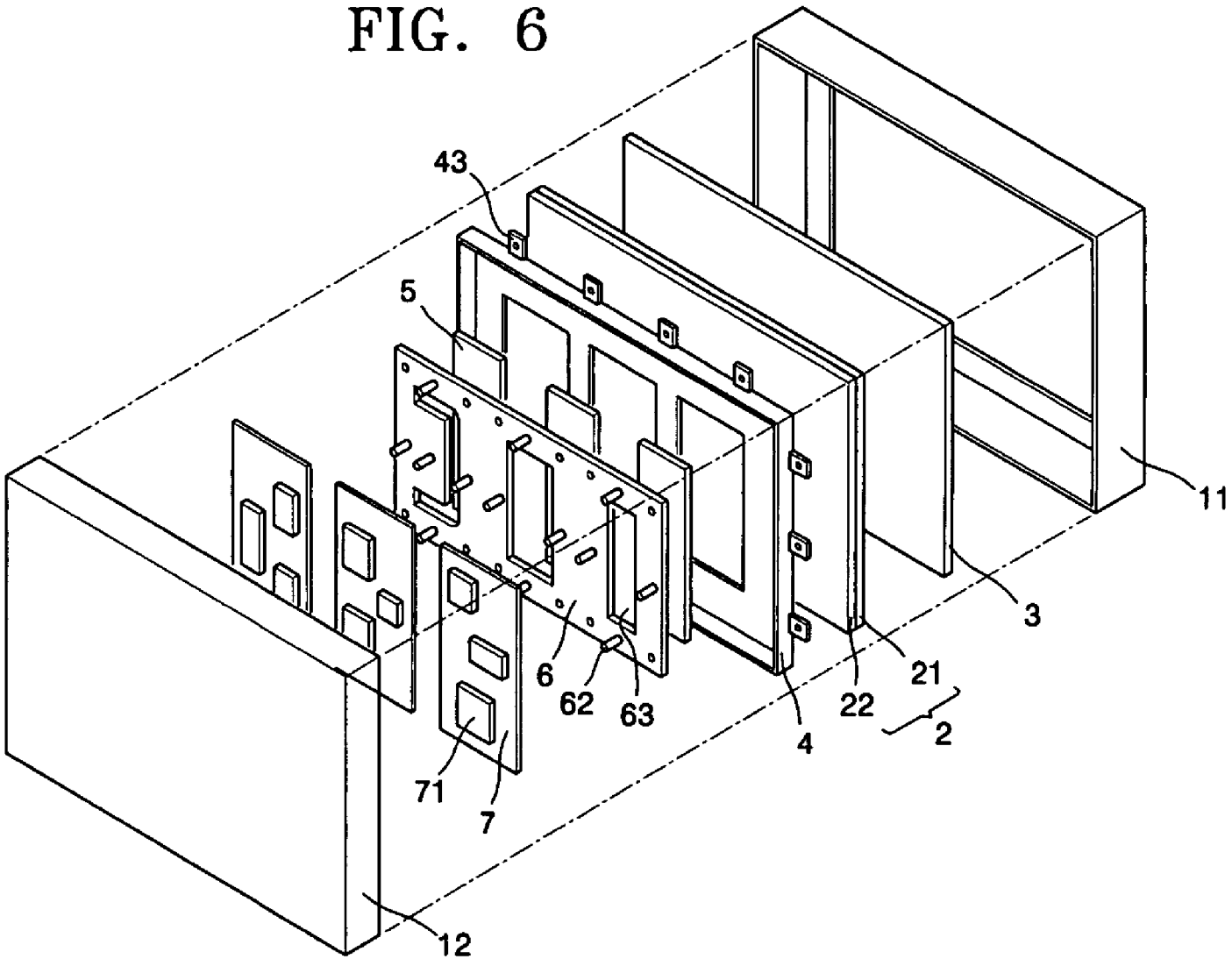
FIG. 6 is an exploded perspective view of a plasma display device having a one-body plate shape auxiliary frame according to another exemplary embodiment of the present invention.

The auxiliary frame 6 may have a different shape than that shown in FIG. 1. For example, the auxiliary frame 6 may have multiple, rectangular shaped plate members with openings 63 as shown in FIG. 5, or it may be a single plate with openings 63 as shown in FIG. 6. In these plate-type auxiliary frames 6, the opening 63 may expose all or a portion of the heat radiation member 5, and the openings 63 may improve the device's heat radiation characteristics. As shown in FIG. 6, the openings 63 may be also be of different sizes and shapes. Forming the auxiliary frame 6 in a plate shape may simplify assembly of a circuit substrate and improve an electromagnetic interference (EMI) shielding effect.

As shown in FIG. 3, a supporting member 61 may be included on a surface of the auxiliary frame 6 facing the heat radiation member 5. The supporting member 61 presses the heat radiation member 5 on the PDP 2 when the auxiliary frame 6 is attached to the frame member 4.

Boss units 62 may be formed on the auxiliary frame 6, as shown in FIG. 1 and FIG. 3, and the circuit board 7, which has many electronic parts 71, may be mounted on the boss units 62.

Mounting the circuit board 7 on the boss units 62 may prevent the transfer of heat from the circuit board's electronic parts 71 to the PDP 2.

Figure 4:
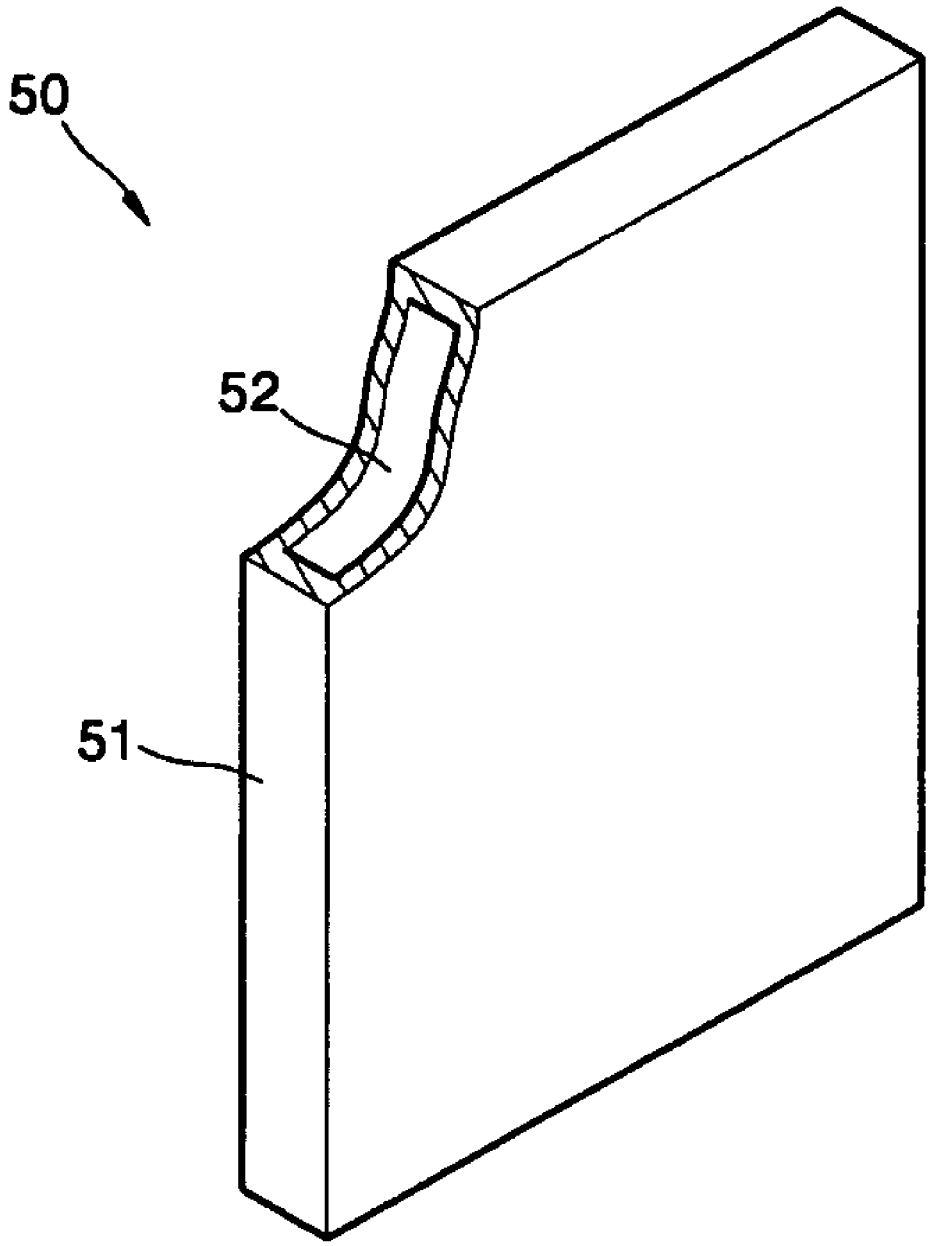
FIG. 4 is a partial broken perspective view showing a heat radiation member according to an exemplary embodiment of the present invention.

As described above, a material having high thermal conductivity may be used for the heat radiation member 5. Alternatively, as shown in FIG. 4, a vapor chamber 50 may be used as the heat radiation member.

The vapor chamber 50 is a heat-pipe having a thin sheet and a metal case 51, an inside 52 of which is a sealed vacuum. A liquid such as water or methanol may be filled in the case 51. The vapor chamber 50 may further increase the heat radiation effect of the PDP 2 since the thermal conductivity coefficient of the vapor chamber 50 may be set to be greater than 1,000 W/mK.

The heat radiation member 5 may be formed by various means, including a matrix resin containing a heat transfer filler. The matrix resin may be formed of an epoxy resin, and the heat transfer filler may be formed of a high thermal conductivity powder, such as aluminum, graphite, copper, silver, nickel, or other like substances.

The heat radiation member 5 may be a metal sheet having high thermal conductivity, such as a sheet of aluminum, copper, silver, nickel, or other like substances, by attaching the sheet to an entire surface of a resin.

Also, the heat radiation member 5 may be formed by sealing a thermally conductive container formed of a thin aluminum foil and filled with a liquid heat radiation material, such as heat radiation grease. The thermally conductive container may alternatively be filled with an appropriately agglomerated powder having high thermal conductivity. The powder may be a metal powder such as aluminum powder, graphite powder, copper powder, silver powder, nickel powder, and other like substances.

Also, a woven carbon fiber, a stack of carbon fibers, and a graphite group having high thermal conductivity may be used as the heat radiation member 5.

Figure 7:
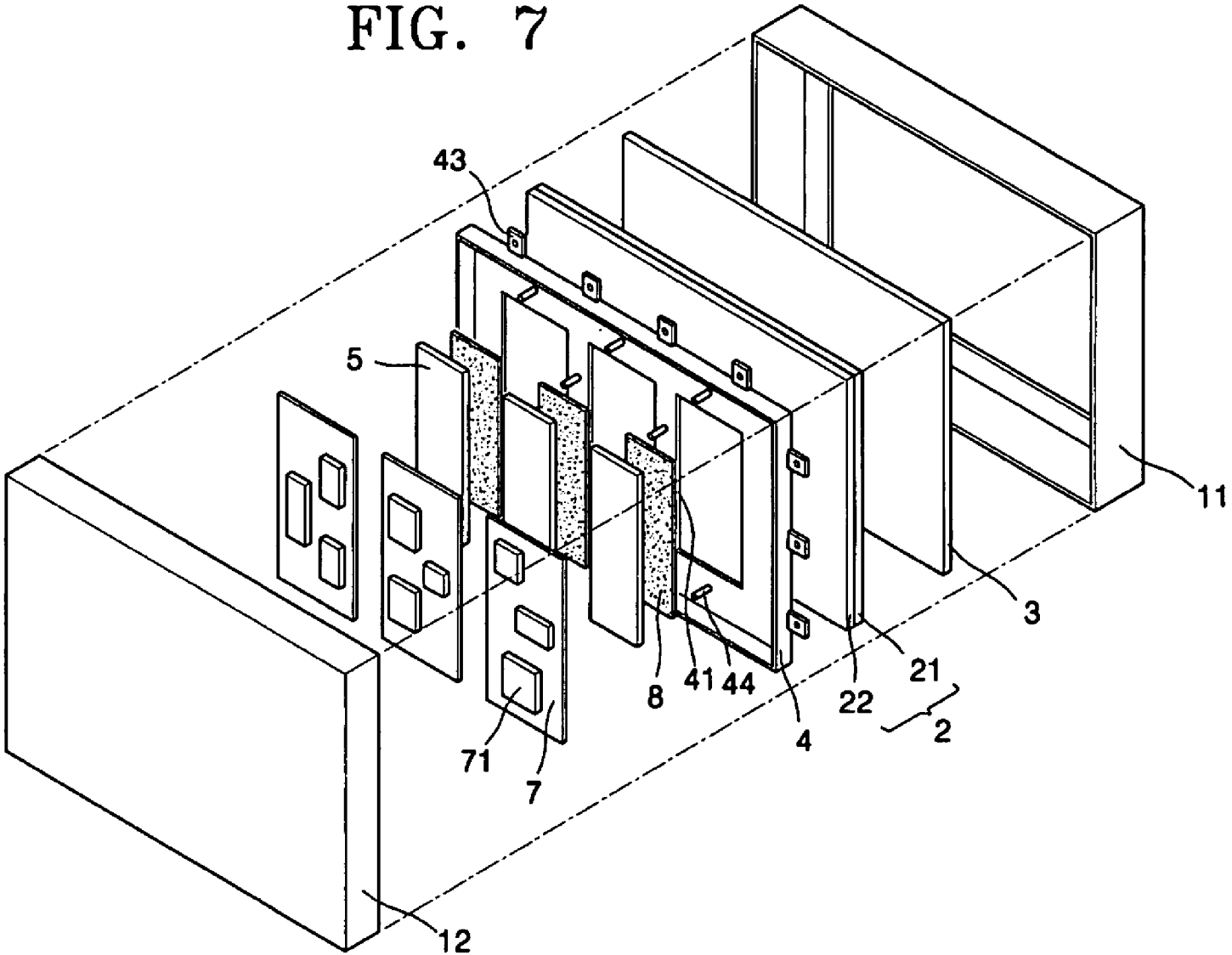
FIG. 7 is an exploded perspective view of a plasma display device according to another exemplary embodiment of the present invention.
Figure 8:
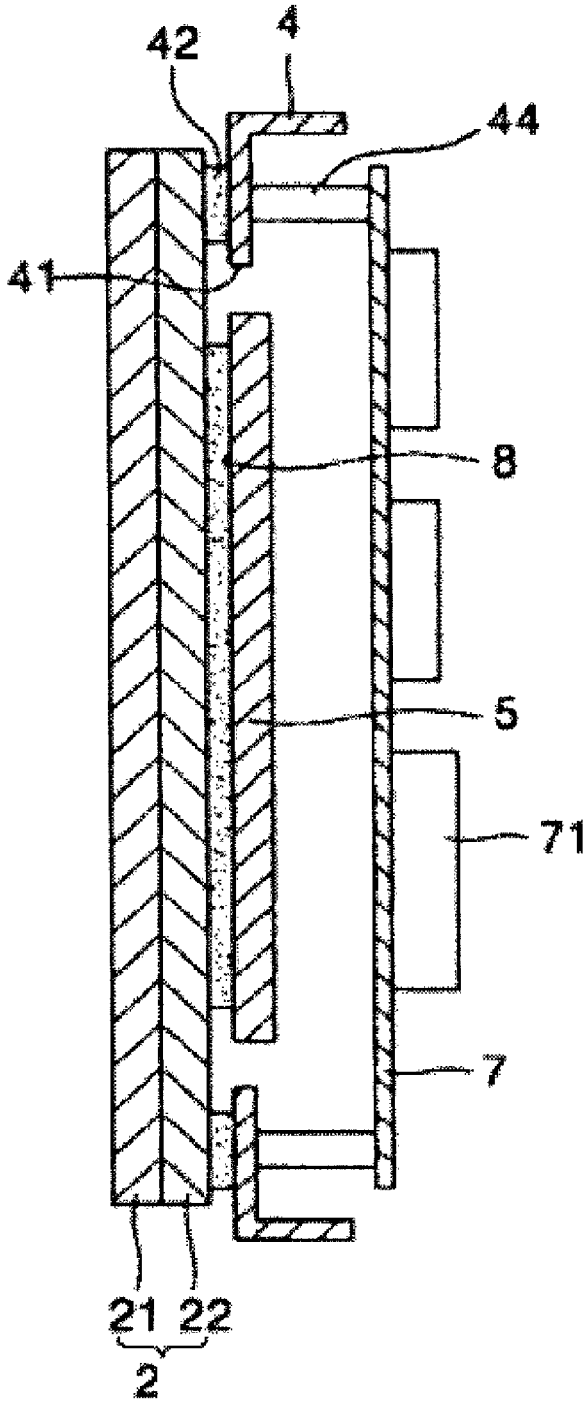
FIG. 8 is a cross-sectional view showing a portion of the plasma display device of FIG. 7.

As described above, exemplary embodiments of the present invention disclose an auxiliary frame 6 supporting the heat radiation member 5, but the present invention is not limited thereto. As shown in FIG. 7 and FIG. 8, the heat radiation member 5 may be adhered to the rear substrate 22 using an adhesive member 8. The adhesive member 8 may be a dual-sided tape having high thermal conductivity or another thermally conductive adhesive.

In this case, the circuit board 7 may be fixed to the boss units 44 that are formed on the frame member 4.

As described above, when the heat radiation member 5 contacts the rear substrate 22 or is adhered to the rear substrate with a thermally conductive adhesive, the heat radiation characteristic of the PDP 2 may improve because the PDP's generated heat is directly transmitted to the heat radiation member 5 without passing through a chassis base, and a space formed between the heat radiation member 5 and the circuit board 7 may prevent heat from transferring from the circuit board 7 to the PDP 2.

As described above, the present invention may provide the following advantages.

First, the heat transfer efficiency in horizontal and vertical directions may increase since a heat radiation member contacts or is adhered to the PDP, which may increase its heat radiation characteristics.

Second, heat may be prevented from transferring from the circuit board to the PDP.

Third, heat radiation may increase since the heat radiation member may contact air.

Fourth, the frame member may appropriately secure the PDP within the cabinet.

Fifth, the heat radiation member may be more firmly pressed against the rear substrate of the PDP.

Sixth, forming openings on the frame member may reduce the weight and material costs of the PDP.

Seventh, the auxiliary frame may increase the EMI shielding effect.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display device, comprising:

a plasma display panel (PDP) on which images are displayed;

a frame member having at least one opening and coupled to the PDP; and at least one heat radiation member disposed in a spaced left unoccupied by the opening.

2. The plasma display device of claim 1, further comprising:

at least one auxiliary frame coupled to the frame member.

3. The plasma display device of claim 2, further comprising:

a supporting unit formed on an inner side of the auxiliary frame and coupled to the heat radiation member.

4. The plasma display device of claim 2, further comprising:

a boss unit formed on an outer side of the auxiliary frame, and a circuit board mounted on the boss unit.

5. The plasma display device of claim 1, further comprising:

a thermally conductive adhesive member interposed between the PDP and the heat radiation member.

6. The plasma display device of claim 5, further comprising:

a boss unit on an outer side of the frame member; and a circuit board mounted on the boss unit.

7. The plasma display device of claim 1, wherein an adhesive member couples the frame member to the PDP.

8. The plasma display device of claim 1, wherein the heat radiation member comprises a thermally conductive case holding a liquid and sealed in a vacuum.

9. The plasma display device of claim 1, wherein the heat radiation member comprises a sheet formed of aluminum, copper, silver, or nickel.

10. The plasma display device of claim 1, wherein the heat radiation member comprises a container formed of a thermally conductive material and holding heat radiation grease.

11. The plasma display device of claim 1, wherein the heat radiation member comprises a container formed of a thermally conductive material and holding a thermally conductive powder.

12. The plasma display device of claim 11, wherein the thermally conductive powder is aluminum powder, graphite powder, copper powder, silver powder, or nickel powder.

13. The plasma display device of claim 1, wherein the heat radiation member comprises a matrix resin containing a heat transfer filler.

14. The plasma display device of claim 13, wherein the heat transfer filler comprises aluminum, graphite, copper, silver, or nickel.

15. The plasma display device of claim 1, wherein the heat radiation member comprises carbon fiber.

16. The plasma display device of claim 1, wherein the heat radiation member comprises a graphite group heat radiation material.

17. The plasma display device of claim 1, further comprising:

at least one plate-shaped auxiliary frame coupled to the frame member and supporting the heat radiation member.

18. The plasma display device of claim 17, further comprising:

an opening formed on the auxiliary frame to expose a portion of the heat radiation member.

19. The plasma display device of claim 1, wherein two or more heat radiation members are disposed in one opening.

* * * * *